United States Patent [19]

Miyaji et al.

[11] Patent Number: 5,049,291

[45] Date of Patent: Sep. 17, 1991

[54] LUBRICATING OIL COMPOSITION FOR TWO-CYCLE ENGINES

[75] Inventors: Tomomi Miyaji; Masahiko Kido, both of Ichihara, Japan

[73] Assignee: Idemitsu Kosan Co., Ltd., Tokyo, Japan

[21] Appl. No.: 400,985

[22] Filed: Aug. 31, 1989

[30] Foreign Application Priority Data

Sep. 30, 1988 [JP] Japan ..... 63-244475

[51] Int. Cl.[5] ..... C10M 141/02

[52] U.S. Cl. ..... 252/33; 252/39; 252/50; 252/51.5 A; 252/56 R; 252/56 S

[58] Field of Search ..... 252/51.5 R, 51.5 A, 252/56 R, 56 S, 39, 33, 50

[56] References Cited

U.S. PATENT DOCUMENTS

| | | | |
|---|---|---|---|
| 3,778,371 | 12/1973 | Malec | 252/54 |
| 3,873,458 | 3/1975 | Parkinson | 252/34 |
| 3,883,501 | 5/1975 | Malec | 252/48.2 |
| 3,992,308 | 11/1976 | Malec et al. | 252/48.2 |
| 4,116,876 | 9/1978 | Brois et al. | 252/49.6 |
| 4,117,011 | 9/1978 | Malec | 44/73 |
| 4,186,102 | 1/1980 | Malec | 252/52 A |
| 4,326,972 | 4/1982 | Chamberlin, III | 252/33.3 |
| 4,533,753 | 8/1985 | McKinnie et al. | 252/45 |
| 4,708,809 | 11/1987 | Davis | 252/33.4 |
| 4,724,091 | 2/1988 | Davis | 252/33.4 |
| 4,740,321 | 4/1988 | Davis et al. | 252/52 R |
| 4,772,406 | 9/1988 | Brois | 252/47.5 |
| 4,776,967 | 10/1988 | Ichihashi et al. | 252/32.7 R |
| 4,776,969 | 10/1988 | Ryers et al. | 252/46.7 |
| 4,832,867 | 5/1989 | Seiki et al. | 252/32.5 |
| 4,877,557 | 10/1989 | Kaneshige et al. | 252/32.7 E |

*Primary Examiner*—Margaret B. Medley

*Attorney, Agent, or Firm*—Frishauf, Holtz, Goodman & Woodward

[57] ABSTRACT

A lubricating oil composition for two-cycle engines comprising (A) 40 to 90% by weight of one or more polymers selected from the group consisting of copolymers of ethylene and an α -olefin and polymers of an α -olefin having 6 to 18 carbon atoms;

(B) 0 to 50% by weight of a polybutene having a kinematic viscosity of 2 to 600 cSt as measured at 100° C.;

(C) 5 to 50% by weight of a hydrocarbonaceous solvent having a boiling point not higher than 300° C.; and (D) 2 to 20% by weight of a lubricating oil additive for two-cycle engines.

The lubricating oil composition for two-cycle engines excels in both cleanliness and anti-seizure property.

20 Claims, No Drawings

LUBRICATING OIL COMPOSITION FOR TWO-CYCLE ENGINES

BACKGROUND OF THE INVENTION (a) Field of the Invention

The present invention relates to a lubricating oil composition for two-cycle engines which excels in both cleanliness and anti-seizure property.

(b) Description of the Related Art

Lubricating system of two-cycle engines can be classified into two types, a mixture method lubrication, by which a mixture of fuel and lubricating oil is fed into engines, and a separate oiling system, by which lubricating oil in a tank separated from fuel tank is fed into engines by means of an oil pump. In either case, lubricating oil is fed into engines and burn after completing lubrication. Lubricating oil for two-cycle engines, therefore, is required to have high anti-seizure property and cleanliness and to burn without generating exhaust smoke.

As lubricating oil compositions for two-cycle engines, there have been known those containing as a main component blends of mineral oil or polybutene with light components, such as kerosene (e.g., Japanese Patent Application Kokoku Koho (Publication) No. 57-34317, Japanese Patent Application Kokai Koho (Laid-open) No. 54-160401). However, there have been problems in that those whose main component is mineral oil are inferior in cleanliness, and that those whose main component is polybutene have poor anti-seizure property. Further, those containing mixtures of mineral oil and polybutene are unsatisfactory in both properties.

SUMMARY OF THE INVENTION

The object of the present invention is to solve the above-described problems of the conventional techniques, and to provide a lubricating oil composition for two-cycle engines which excels in both cleanliness and anti-seizure property and generates a reduced amount of exhaust smoke.

That is, the present invention provides a lubricating oil composition for two-cycle engines comprising (A) 40 to 90% by weight of one or more polymers selected from the group consisting of coploymers of ethylene and an α-olefin and polymers of an α-olefin having 6 to 18 carbon atoms;

(B) 0 to 50% by weight of a polybutene having a kinematic viscosity of 2 to 600 cSt as measured at 100° C.;

(C) 5 to 50% by weight of a hydrocarbonaceous solvent having a boiling point not higher than 300° C.; and (D) 2 to 20% by weight of a lubricating oil additive for two-cycle engines.

The lubricating oil composition for two-cycle engines of the present invention excels in both cleanliness and anti-seizure property and completely burns in engines without generating exhaust smoke.

DESCRIPTION OF THE PREFERRED EMBODIMENTS

Among the copolymers of ethylene and an α-olefin ($A_1$ component) which may be used as the polymers (A) in the present invention, the preferred have a kinematic viscosity of 2 to 600 cSt, more preferably 3 to 300 cSt, as measured at 100° C. Those having a kinematic viscosity of less than 2 cSt as measured at 100° C. may sometimes cause insufficient anti-seizure property of the resulting lubricating oil composition, and those having a kinematic viscosity of more than 600 cSt may sometimes deteriorate cleanliness. When two or more copolymers of ethylene and α-olefins are used as the $A_1$ component, it is sufficient if the mixture of the copolymers has a kinematic viscosity within the above-described range. Typical examples of the copolymers of ethylene and an α-olefin which can be suitably used in the present invention are hydrocarbonaceous synthetic oils which are copolymers of ethylene and α-olefins having 3 to 20 carbon atoms, such as propylene, 1-butene, and 1-decene, and have no polar group.

Among the polymers of α-olefins having 6 to 18 carbon atoms ($A_2$ component) which also may be used as the polymers (A) in the present invention, the preferred have a kinematic viscosity of 2 to 600 cSt, more preferably 3 to 300 cSt, as measured at 100° C. Such polymers may be of various kinds, and suitably used are poly-α-olefins, the main components of which are oligomers not lower than dimer which are obtainable by polymerization (particularly, low grade polymerization) or copolymerization of α-olefins by using various methods, such as a method using Ziegler catalysts, a method of radical polymerization, a method using aluminum chloride catalysts, and a method using catalysts consisting of boron fluoride and alcohols. The materials, i.e. α-olefins (i.e., the constituting units of the poly-α-olefins), to be used are α-olefins having 6 to 18, preferably 8 to 12 carbon atoms. Typically, one or more α-olefins selected from 1-octene, 1-nonene, 1-decene, 1-undecene, 1-dodecence, and the like may be used. The particularly preferred α-olefins are 1-octene, 1-nonene, 1-decene, and 1-dodecene.

If the kinematic viscosity of the $A_2$ component is less than 2 cSt, anti-seizure property of the lubricating oil composition may sometimes become insufficient, and those having a kinematic viscosity of more than 600 cSt may sometimes deteriorate cleanliness. When two or more polymers of α-olefins are used as the $A_2$ component, it is sufficient if the mixture of the polymers has a kinematic viscosity within the above-described range.

If the content of the component (A) in the lubricating oil composition of the present invention is less than 40% by weight, the anti-seizure property of the lubricating oil composition will become poor, and on the other hand, a content of the component (A) more than 90% by weight is undesirable because such a content reduces the contents of the other components considerably. The preferred content of the component (A) is 50 to 85% by weight.

The component (B), i.e., polybutene, to be used in the present invention has a kinematic viscosity of 2 to 600 cSt as measured at 100° C. When two or more polybutenes are used as the B component, it is sufficient if the mixture of the polybutenes has a kinematic viscosity within the above-described range. The polybutene is not essential to the lubricating oil composition of the present invention, and is used in an amount of not more than 50% by weight. It has the effect of further improving the cleanliness of the lubricating oil composition. If the amount of the component (B) blended in the lubricating oil composition of the present invention exceeds 50% by weight, the anti-seizure property of the lubricating oil composition will be deteriorated. Therefore, the preferred amount of the component (B) blended is 5 to 40% by weight.

The component (C), i.e., the hydrocarbonaceous solvent to be used in the present invention may be a petroleum or synthetic hydrocarbonaceous solvents having a boiling point of not higher than 300° C. at atmospheric pressure. Typical examples of the petroleum hydrocarbonaceous solvents may be used include gasoline, kerosene, gas oil, etc., and typical examples of the synthetic hydrocarbonaceous solvents include dimer to hexamer, etc. of propylene, butene, etc. Particularly, among these synthetic hydrocarbonaceous solvents consisting of low grade polymers of butene may be suitably used because of their high efficiency in improving the anti-seizure property.

If the content of the hydrocarbonaceous solvent in the lubricating oil composition of the present invention is less than 5% by weight, the cleanliness of the lubricating oil composition will be deteriorated, and if it exceeds 50% by weight, the anti-seizure property will be deteriorated.

Some examples of the component (D), i.e., the lubricating oil additives for two-cycle engines, to be used in the present invention include additives which are generally added into lubricating oil compositions for two-cycle engines, for example, ash-free dispersants, surfactants, detergents, pour point depressants, rust inhibitors, and antifoaming agents, etc, and these are added in order to improve the characteristics of the lubricating oil composition of the present invention, within the range where the object of the present invention is not prevented from being achieved.

Some illustrative examples of the component (D) include sulfonates of alkaline earth metals, phenates of alkaline earth metals, phosphonates of alkaline earth metals, alkenylsuccinimides, benzylamine, and amides of tetraethylenepentamine with long chain aliphatic acids.

It is desirable to blend these components (A) to (D) so as to obtain a lubricating oil composition having a kinematic viscosity of 5 to 15 cSt, preferably 6 to 12 cSt, as measured at 100° C. If the kinematic viscosity of the lubricating oil composition is less than 5 cSt, the anti-seizure property may sometimes be deteriorated, and if it exceeds 15 cSt, the formation of mist in case of separate oiling system may sometime becomes difficult.

Into the lubricating oil composition of the present invention, there may be added, in addition to the components (A) to (D), small amounts of other base oils, such as ester synthetic oils and mineral oil. In such a case, it is preferable only to add those having relatively low viscosities (for example, not more than 20 cSt as measured at 100° C.) in small amounts for example, about 10% by weight.

The following examples are given by way of illustration to further explain the principles of the invention. These examples are merely illustrative and are not to be understood as limiting the scope of the invention in any way.

EXAMPLES 1 TO 9 AND COMPARATIVE EXAMPLES 1 TO 4

Lubricating oils for two-cycle engines having the compositions shown in Table 1 and Table 2 were prepared, and the properties of the obtained lubricating oils were measured according to the following evaluation methods. The results of the evaluation are shown in Table 1 and Table 2. In Table 1 and Table 2, the amount of each component is shown in % by weight based on the total lubricating oil amount.

EVALUATION METHODS

1. Cleanliness

Evaluation of cleanliness was conducted by using a panel coking method according to Federal Test Method 791B . 3462. According to the test method, a cycle of 15 sec. splash - 45 sec. interruption was operated repeatedly for 3 hours under the conditions of panel temperature: 300° C. and oil temperature: 120° C., and then cleanliness was evaluated depending on the amount (mg) of carbon adhered to the panel surface.

2. Anti-seizure property

Evaluation of anti-seizure property was conducted by measuring the time required for seizing to occur by using a Falex test machine according to ASTM D 2625, 2670.

The test conditions were such that; number of revolutions: 290 rpm, load: 700 Lbs, material of pin: aluminum alloy, material of block: standard test piece (steel). Formation of oil film on the pin surface was carried out by coating the pin with each of the above-described lubricating oils by dipping the pin in the lubricating oil, and then subjecting the pin to oil draining for 60 sec.

TABLE 1

| | Compositions | | Example Nos. 1 | 2 | 3 | 4 | 5 | 6 | 7 | 8 | 9 |
|---|---|---|---|---|---|---|---|---|---|---|---|
| $A_1$ | Ethylene-propylene copolymers | 5 cSt @ 100° C. | 50.0 | | | | | | | 40.0 | |
| | | 10 cSt @ 100° C. | | 65.0 | 65.0 | 60.0 | | 45.0 | 61.0 | | 55.0 |
| | | 50 cSt @ 100° C. | | | | 8.0 | | 8.0 | | | |
| | | 100 cSt @ 100° C. | | 5.0 | 5.0 | | | | 21.0 | | 5.0 |
| | | 500 cSt @ 100° C. | 22.0 | | | | | | | 22.0 | |
| $A_2$ | Oligomers of 1-decene | 10 cSt @ 100° C. | | | | | 60.0 | | | | |
| | | 50 cSt @ 100° C. | | | | | 8.0 | | | | |
| B | Polybutene | 10 cSt @ 100° C. | | | | | | 15.0 | | | |
| | Polybutene | 200 cSt @ 100° C. | 10.0 | 10.0 | 10.0 | 10.0 | 10.0 | 10.0 | | 10.0 | 10.0 |
| C | Kerosene | | | | 13.0 | | | | | | |
| | Mixture of trimers and tetramers of butene | | 11.0 | 13.0 | | 15.0 | 15.0 | 15.0 | 11.0 | 11.0 | 13.0 |
| D | Lubricating oil additives for two-cycle engines | | 7.0 | 7.0 | 7.0 | 7.0 | 7.0 | 7.0 | 7.0 | 7.0 | 7.0 |
| | Mineral oil 150N | | | | | | | | | 10.0 | |
| | Dioctylester of dimer acid | | | | | | | | | | 10.0 |
| Result | | | | | | | | | | | |
| Viscosity cSt @ 100° C. | | | 8.48 | 8.43 | 8.32 | 8.25 | 8.16 | 8.05 | 8.49 | 8.39 | 8.59 |
| Cleanliness mg | | | 30 | 28 | 32 | 15 | 18 | 12 | 37 | 41 | 25 |
| Anti-seizure | | | 75 | 72 | 60 | 70 | 62 | 60 | 79 | 73 | 61 |

TABLE 1-continued

| Compositions | Example Nos. 1 | 2 | 3 | 4 | 5 | 6 | 7 | 8 | 9 |
|---|---|---|---|---|---|---|---|---|---|
| property Sec | | | | | | | | | |

D: Alkenylsuccinimide (6.0)
Basic calcium sulfonate (1.0)
C: Range of boiling point 140~220° C.

TABLE 2

| | Compositions | | Comparative Example Nos. 1 | 2 | 3 | 4 |
|---|---|---|---|---|---|---|
| $A_1$ | Ethylene-propylene copolymers | 10 cSt @ 100° C. | | | 29.0 | |
| | | 50 cSt @ 100° C. | | | 5.0 | |
| | Mineral oil | | | | | |
| | 150N | | | 40.0 | | |
| | 500N | | 70.0 | | 35.0 | |
| | B.S | | | 30.0 | | |
| B | Polybutene | 10 cSt @ 100° C. | | | | 70.0 |
| | Polybutene | 200 cSt @ 100° C. | 10.0 | 10.0 | 10.0 | 10.0 |
| C | Mixture of trimers and tetramers of butene | | 13.0 | 13.0 | 14.0 | 13.0 |
| D | Lubricating oil additives for two-cycle engines | | 7.0 | 7.0 | 7.0 | 7.0 |
| Result | | | | | | |
| Viscosity cSt @ 100° C. | | | 8.21 | 8.16 | 8.12 | 8.05 |
| Cleanliness mg | | | 129 | 172 | 75 | 15 |
| Anti-seizure property Sec | | | 50 | 70 | 54 | 12 |

C and D are as described in Table 1.

What is claimed is;

1. A lubricating oil composition for two-cycle engines comprising (A) 40 to 90% by weight of one or more polymers selected from the group consisting of (a) copolymers of ethylene and an α-olefin and (b) polymers of an α-olefin 6 to 18 carbon atoms, said one or more polymers having a kinematic viscosity of 2 to 600 cSt as measured at 100° C.;

(B) 0 to 50% by weight of a polybutene having a kinematic viscosity of 2 to 600 cSt as measured at 100° C.;

(C) 5 to 50% by weight of a hydrocarbon solvent selected from the group consisting of a dimer of butene, a trimer of butene, a tetramer of butene, a pentamer of butene, a hexamer of butene and mixtures thereof and having a boiling point not higher than 300° C. and (D) 2 to 20% by weight of a lubricating oil additive for two-cycle engines.

2. The lubricating oil composition for two-cycle engines as claimed in claim 1, wherein said lubricating oil composition for two cycle engines has a kinematic viscosity of 5 to 15 cSt as measured at 100° C.

3. The lubricating oil composition for two-cycle engines as claimed in claim 1, wherein the amount of said polybutene is 5 to 40% by weight.

4. The lubricating oil composition for two-cycle engines as claimed in claim 1, wherein said one or more polymers are selected from the group consisting of ethylene-propylene copolymers and oligomers of 1-decene.

5. The lubricating oil composition for two-cycle engines as claimed in claim 1, wherein said hydrocarbon solvent is a mixture of trimer and tetramer of butene.

6. The lubricating oil composition for two-cycle engines as claimed in claim 1, wherein said lubricating oil additive is selected from the group consisting of sulfonates of alkaline earth metals, phenates of alkaline earth metals, alkenylsuccinimides, benzylamine, and amides of tetraethylenepentamine with long chain aliphatic acids.

7. The lubricating oil composition for two-cycle engines as claimed in claim 1, wherein said lubricating oil additive is a mixture of alkenylsuccinimides and basic calcium sulfonate.

8. The lubricating oil composition for two-cycle engines according to claim 1, wherein the total amount of said one or more polymers (A) is 50 to 85% by weight.

9. The lubricating oil composition for two-cycle engines according to claim 3, wherein said polymers (A) have a kinematic viscosity of 3 to 300 cSt as measured at 100° C.

10. The lubricating oil composition for two-cycle engines according to claim 3, wherein said one or more polymers are (a) copolymers of ethylene and an α-olefin and said α-olefin has 3 to 20 carbon atoms.

11. The lubricating oil composition for two-cycle engines according to claim 3, wherein said one or more polymers are α-olefins having 6 to 18 carbon atoms selected from the group consisting of 1-octene, 1 nonene, 1-decene, 1-undecene and 1-dodecene.

12. The lubricating oil composition for two-cycle engines according to claim 3, wherein said lubricating oil additive is selected from the group consisting of ash-free dispersants, surfactants, detergents, pour point depressants, rust inhibitors and antifoaming agents.

13. A lubricating oil composition for two-cycle engines according to claim 3, wherein said lubricating oil composition has a kinematic viscosity of 6 to 12 cSt as measured at 100° C.

14. A lubricating oil composition for two-cycle engines according to claim 3, which further comprises a small amount of a base oil selected from the group consisting of ester synthetic oils and mineral oil.

15. A lubricating oil composition for two-cycle engines according to claim 14, wherein said base oil has a viscosity of not more than 20 cSt as measured at 100° C.

16. A lubricating oil composition for two-cycle engines comprising (A) 40 to 88% by weight of one or more polymers selected from the group consisting of ethylene-propylene copolymers and oligomers of 1-decene, said one or more polymers having a kinematic viscosity of 2 to 600 cSt as measured at 100° C.;

(B) 5 to 40% by weight of a polybutene having a kinematic viscosity of 2 to 600 cSt as measured at 100° C.;

(C) 5 to 50% by weight of a hydrocarbon solvent having a boiling point not higher than 300° C. selected from the group consisting of, a dimer of butene, a trimer of butene, a tetramer of butene, a pentamer of butene, a hexamer of butene and mixtures thereof; and (D) 2 to 20% by weight of a lubricating oil additive for two-cycle engines selected from the group consisting of sulfonates of alkaline earth metals, phenates of alkaline earth metals, alkenylsuccinimides, benzylamine, and amides of tetraethylenepentamine with long chain aliphatic acids.

17. A lubricating oil composition for two cycle engines as claimed in claim 16, wherein said lubricating oil composition for two cycle engines has a kinematic viscosity of 5 to 15 cSt as measured at 100° C.

18. A lubricating oil composition for two cycle engines as claimed in claim 16, wherein said hydrocarbon solvent is a mixture of a trimer and a tetramer of butene; wherein said lubricating oil additive is a mixture of alkenylsuccinimides and basic calcium sulfonate; wherein the total amount of said one or more polymers (A) is 50 to 85% by weight; wherein said polymers (A) have a kinematic viscosity of 3 to 300 cSt as measured at 100° C. and wherein the lubricating oil composition has a kinematic viscosity of 6 to 12 cSt as measured at 100° C.

19. A lubricating oil composition for two cycle engines claimed in claim 14, wherein the amount of base oil is 10% by weight.

20. A lubricating oil composition for two cycle engines as claimed in claim 1, wherein (A) is a polymer of ethylene and an α-olefin.

* * * * *